United States Patent [19]

Hirayama et al.

[11] 3,941,689

[45] Mar. 2, 1976

[54] APPARATUS FOR SORTING WASTE FOR DISPOSAL

[75] Inventors: Yoshio Hirayama, Kamakura; Kanichi Ito, Yokohama, both of Japan

[73] Assignee: Ebara Manufacturing Co., Ltd., Tokyo, Japan

[22] Filed: Aug. 14, 1974

[21] Appl. No.: 497,275

[30] Foreign Application Priority Data

Aug. 27, 1973 Japan ..... 48-95948

[52] U.S. Cl. ..... 209/296

[51] Int. Cl.[2] ..... B07B 1/24

[58] Field of Search ..... 209/77, 82, 83, 98, 99, 209/273, 284, 294, 296, 298, 299, 300, 380; 210/152, 173, 413–415; 241/152 A, 154, 69, 73, 74, 60, 61, 62

[56] References Cited

UNITED STATES PATENTS

| | | | |
|---|---|---|---|
| 1,677,862 | 7/1928 | Herrold | 209/98 X |
| 2,846,153 | 8/1958 | Krogh | 209/299 X |
| 3,011,220 | 12/1961 | Keller | 241/154 X |
| 3,224,688 | 12/1965 | Beiter | 241/154 |
| 3,391,785 | 7/1968 | Hosokawa | 209/300 |
| 3,506,201 | 4/1970 | Engels | 241/154 |

*Primary Examiner*—Stanley H. Tollberg
*Attorney, Agent, or Firm*—James E. Nilles

[57] ABSTRACT

An apparatus is presented for effectively sorting and disposing of waste. Waste is sorted into three or more groups enabling post treatment or reutilization of the sorted waste with less possibility of environmental contamination. The apparatus comprises mainly a drum having a plurality of screen means and a plurality of rotatable reducing means, each of the reducing means facing a corresponding screen means, respectively and being driven at a properly selected speed depending on the constituents of the waste and the mesh size of the opposing screen.

5 Claims, 2 Drawing Figures

APPARATUS FOR SORTING WASTE FOR DISPOSAL

FIELD OF THE INVENTION

The present invention relates to an apparatus for disposing of waste such as municipal waste and more particularly relates to an apparatus for progressively pulverizing municipal waste or the like comprising a mixture of various constituents and for selectively separating or sorting the same.

BACKGROUND OF THE INVENTION

In disposing of municipal waste, a drum pulverizer has been used quite often. In case of a drum pulverizer primarily employed for producing fertilizer out of the municipal waste, a drum is rotatably supported by a roller means, the drum axis being slightly canted relative to the horizon and is driven by a motor through a gear means. The drum is provided with an inner cylindrical screen and the municipal waste received therein is turned and advanced as the drum rotates. The waste is sprayed with water in this case and the constituents of the waste such as waste paper, straw, grass and plants and garbage or the like tending to absorb moisture are selectively struck and mashed into small size by cans, bottles or pebbles contained in the waste and are passed through the screen so as to be discharged from an outlet of the drum.

Therefore, the municipal waste is only sorted into two groups by means of the drum pulverizer heretofore used and the efficiency of separation is degraded by clogging of the screen mesh. Further the screening of the pulverized waste with the drum pulverizer of the prior art relies on gravity and, thus, the screening rate is naturally limited and a high rate is not attained since the acceleration applied on the pulverized waste is only 1 $g$ ($g$ = gravitational acceleration).

SUMMARY OF THE INVENTION

Accordingly, it is an object of the present invention to provide an apparatus for sorting and disposing of waste which is free of the drawbacks above.

It is a further object of the present invention to provide an apparatus by which the waste can be treated after pulverization so as to increase the utilization of the waste.

Another object of the present invention is to provide means for sorting the waste into a plurality of groups for more effective utilization of the waste.

Still another object of the present invention is to increase the efficiency or capacity of sorting the pulverized waste by applying the increased acceleration thereon.

It is also an object of the present invention to decrease the frequency of clogging the screen mesh during processing of the waste.

The objects above are accomplished by the apparatus of the present invention.

The apparatus of the present invention is provided with at least two sorting screens each being accompanied by a reducing means such as hammers, shearing or beating blades so as to sort the waste into a plurality of groups. These screens are mounted on a stationary drum of the apparatus and there is a discharge opening at a position adjacent each of the respective screens. The rotational speed of each reducing means is individually adjusted to a suitable rate. Also, the mesh of each screen may be different to increase the efficiency of sorting or to improve the quality of the sorted waste. Also it is considered that the relative circumferential speed of each reducing means with respect to its corresponding screen may be varied depending on the constituents of the waste.

The present invention together with its objects and advantages discussed above and those not yet touched upon will become apparent to those skilled in the art when the detailed description of the preferred embodiment which follows is reviewed.

DETAILED DESCRIPTION OF THE PREFERRED EMBODIMENT

Figure 1:
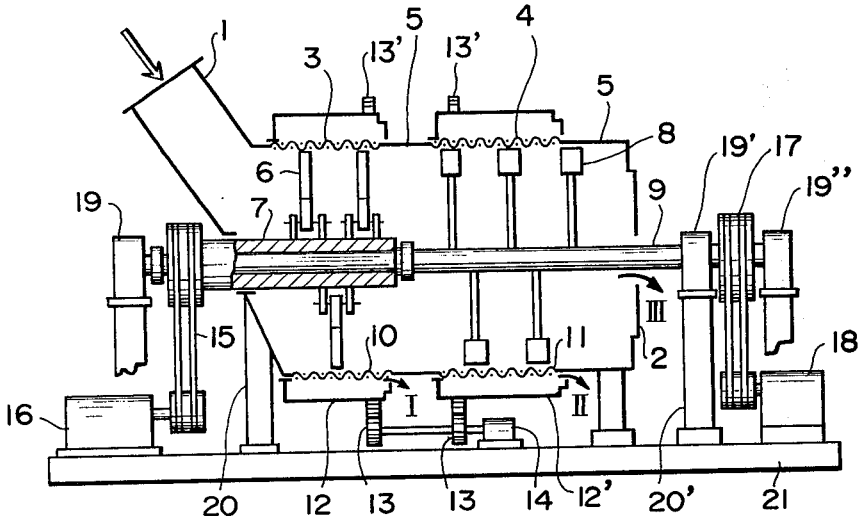
FIG. 1 is a cross section of the apparatus according to the present invention.

Referring to FIG. 1, there is shown one preferred embodiment of the present invention as an illustrative example. The process carried out by the apparatus for sorting and disposing of waste in this embodiment comprises two stages of separating or sorting the waste and thereby it segregates the waste into three groups I, II and III as shown. However, this does not mean that the sorting by the present invention is limited to segregation into three groups and, of course, it is possible to increase the number of the sorting groups to the extent that the mechanical design of the apparatus permits.

Returning to the drawing, there is shown a hopper 1 at one end of the apparatus for receiving the waste and a discharge opening 2 at the other end. A first screen 3 and a second screen 4 are mounted on a stationary drum 5. The mesh size of respective screens may be different, for example, the mesh of the first screen may be relatively small compared to that of the second screen. However, both may be the same size. Facing the first and second screens 3 and 4 are a group of hammers 6 and a group of beating blades 8 mounted, within the drum 5, on rotatable shafts 7 and 9, respectively. These shafts are preferably disposed so that an end of one shaft may be journaled within the hollow end of the other shaft for convenience of bearing purpose. In the illustrated embodiment, the end of the shaft 9 is journaled in the hollow end of the shaft 7 so that the end of the latter acts as a bearing to permit relative rotation between the two shafts 7 and 9. More specifically, the shaft 9 in this embodiment is constructed so as to extend over the entire drum length and to be rotatably supported at the opposite ends of the drum 5 by bearings 19, 19' and 19''. At the left hand of the shaft 9 in the drawing, the hollow tubular shaft 7 is coaxially placed on the shaft 9 so as to rotate about the shaft 9. The mounting of the hammers 6 above may be similar to that of the blades 8; however, it is preferable to mount the respective hammers 6 so rockably on a suitable bracket means provided on the shaft 7 so that centrifugal force may be applied on the hammers when they are rotated. Also the hammers 6 may be replaced with the ones similar to the blades 8.

The drum 5 is cylindrical in form and may be disposed horizontally with respect to the axis thereof or disposed with its axis canted slightly relative to the horizon by supporting columns 20 and 20' on a base 21. The hollow shaft 7 is driven by a motor 16 through a suitable power transmitting means 15 (which is a belt in the illustrated embodiment) so that the respective hammers 6 rotate while opposing the first cylindrical screen 3. Similarly, the shaft 9 is driven by a motor 18 through a suitable power transmitting means such as a belt 17 so that the scraping blades 8 rotate while opposing the second screen 4.

At the outer side of the screens 3 and 4 of the drum 5, there are disposed rotatable outer cylinders 12 and 12' surrounding the screens 3 and 4, respectively. The inner surfaces of outer cylinders 12 and 12' are provided with blades (not shown) arranged helically on the inside thereof so as to discharge the pulverized waste I and II passed through the respective screens through the respective discharge openings 10 and 11 when the outer cylinders are rotated. The rotation of the outer cylinders 12 and 12' is effected by any suitable means such as motor 14 and gear mechanism comprising drive gears 13 and driven gears 13' fixed on the outer surface of the outer cylinders 12 and 12'.

Now the operation of the apparatus is explained. Waste such as collected municipal waste is charged into the drum 5 through the hopper 1. At first, the constituents of the waste least resistant to impact such as clay, sand, glass, pottery, garbage (kitchen refuse) or the like are instantly crushed by the hammers 6. Such waste becomes granular waste I which will be passed through the screen 3 into the outer cylinder 12 and thence discharged outwardly from the opening 10.

Figure 2:
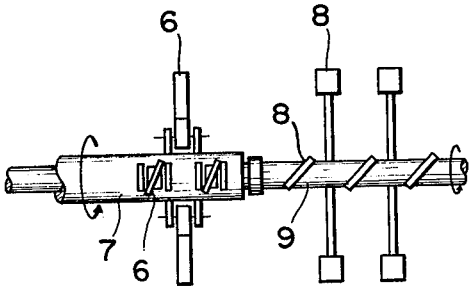
FIG. 2 is a partial drawing illustrating the helical twist of the size reducing means so as to advance the waste in the drum.

The rest of the waste is advanced inside of the drum in the direction toward the opening 2 due to the inclination of the axis of the drum 5 or the arrangement of the hammers 6 and blades 8 as schematically illustrated in FIG. 2 so as to gradually advance the waste axially due to the helically twisted shape of the hammers 6 and blades 8 when the shafts 7 and 9 are rotated. During the advancement of the waste as above, the constituents such as waste paper, straw, or the like having greater resistance to impact or shearing action are selectively pulverized or sheared by beating blades 8 then passed through the second screen 4 into the outer cylinder 12' by centrifugal action of the blades 8 and finally discharged as waste II out of the discharge opening 11 by the rotation of the outer cylinder 12'. The waste III left within the drum 5 at this stage comprises the constituents having the greatest toughness — the most resistance to impact and shearing — such as metals, plastics, rubber, hides, and pieces of wood. This Waste III is discharged from the discharge opening 2 of the drum.

As explained above, by utilization of the preferred embodiment of the present invention, municipal waste comprising several kinds of constituents is progressively crushed and/or pulverized and, according to the physical characteristics of the constituents, is effectively sorted into three groups I, II and III.

As the shafts 7 and 9 are arranged to be driven independently by employment of respective motors 16 and 18, it is possible that circumferential speed of each set of hammers 6 and blades 8 can be selected to achieve the ideal screening efficiency $\eta$ depending on the nature of the constituents contained in the waste. The screening efficiency $\eta$ is defined by the following equation:

$\eta$ = 1 - (intermixed ratio of the constituents of the waste other than those to be sorted)

Also it is possible to add moisture to the waste at the time when waste paper, straw or the like are reduced or pulverized prior to passing through the second screen 4 so as to weaken the strength of the waste thereby increasing the screening efficiency as well as reducing or saving power. For this purpose, water nozzle means (not shown) may be disposed between the first and second screens.

Further, according to the present invention, the constituents of the waste tending to generate or produce harmful gases or materials when they are incinerated such as plastics, rubber or the like are substantially removed. Therefore, the present invention provides remarkable advantages in that waste processed within the apparatus, can be re-utilized to the maximum and contamination of environment is kept to a minimum.

Now the advantages derived from the mechanism of the present invention are summarized. Since the apparatus utilizes the acceleration given by the rotation of the hammers 6 and the beating blades 8, the pulverized waste passing through the screens 3 or 4 is given acceleration as high as 1.5 to 400 times gravitational acceleration whereby the screening efficiency is remarkably improved. Further, the rotating feature of the hammers and beating blades both serving as size reducing means contributes to make it easy to crush or pulverize the waste, to facilitate agitating the waste and to increase the screening efficiency.

The increased acceleration applied on the waste makes it possible to charge a relative large volume of the waste into the hopper compared to that of the prior apparatus which relies on only the standard or unit gravitational acceleration applied on the pulverized waste since the sorting speed is remarkably improved by use of the present apparatus.

Further, it is appreciated that, according to the hammering and agitating effect afforded by the hammers and beating blades, small pieces of waste which tend to clog the mesh of the screens in the prior art are forcibly passed through the screens thereby avoiding the clogging of the screen which degrades the screening efficiency and is the common drawback encountered in most screening devices of the prior art. Also, by the advantages discussed above, the entire area of the respective screens is substantially utilized in contrast to the prior apparatus in which a large part is not used. For example, the capacity of the apparatus for treating the waste is increased to two or three times that of the prior apparatus.

The number and arrangement of the hammers and beating blades is properly selected depending on the constituents of the waste. Also, in addition to the selection above, the adjustment of the respective gaps between the tips of the hammers / blades and the opposing screens is made so as to control the size of the respective sorted waste and so as to discharge uncrushable waste such as pieces of steel or the like from the discharge opening at the end of the drum opposite the hopper thereby providing safety means without adding the means ordinarily required to protect the apparatus from materials which might otherwise damage the elements of the apparatus. As explained above, the sorting and pulverizing operations are performed simultaneously within a single common drum and, thus, the present apparatus is also advantageous in reducing the necessary installation area and manufacturing cost.

The embodiment explained above is only one example of the present invention, and it may be modified in various ways by those skilled in the art. For example, as already touched upon in the foregoing paragraphs, the number of the sorting stages may be increased so as to provide capability to sort the waste into more than three groups. This may be accomplished by employing concentrical shafts, one being housed within the other hollow shaft and so on and driven independently. In the illustrated embodiment, driving sources 16 and 18 are disposed at opposite ends of the drum 5, respectively; however, it is also possible to locate these sources at one side of the drum 5. Also one of the driving sources may be eliminated if an appropriate differential speed coupling is employed between the shafts 7 and 9. The respective speeds of the hammers 6 and beating blades 8 are selected giving due consideration to the respective mesh sizes of the screens 3 and 4, the constituents contained in the waste and, thus, they are generally different from each other; however, under certain conditions they may be the same.

Also it is noted that, instead of the hammers 6 facing the first screen 3, a group of scraping blades are alternately and preferably employed to obtain a desired end. This choice is also dependent on the condition explained above.

The invention has been described in detail with particular reference to the preferred embodiment, but it will be understood that variations and modifications can be effected within the spirit and scope of the invention.

What is claimed is:

1. An apparatus for disposing of and sorting waste, comprising:

a hopper for receiving waste;

a cylindrical drum communicating with said hopper and having a discharge opening, said drum being provided with a first screen and a second screen axially disposed; and a first and second reducing means in opposed relation to said first and second screens, respectively;

supporting means for rotatably supporting said first and second reducing means so as to rotate said reducing means within said drum, a first portion of said supporting means supporting said first reducing means being coaxial with a second portion of said supporting means supporting said second reducing means, driving means for driving said first and second reducing means at an independent rotational speed, respectively through said supporting means;

a first outer cylinder and a second outer cylinder disposed around said first and second screens, respectively, said first and second outer cylinders being provided witha discharge opening, respectively, so as to discharge the sorted waste received therein which has passed through the corresponding screen.

2. An apparatus as claimed in Claim 1, wherein said supporting means are a first shaft and a second shaft on which said first and second reducing means are mounted, respectively, said first and second shafts being coupled to individual driving sources, respectively.

3. An apparatus as claimed in Claim 1 wherein said reducing means are constructed and arranged within the drum so that the waste received in the drum from the hopper is advanced toward the discharge opening upon rotation of the reducing means.

4. An apparatus as claimed in Claim 1 wherein the mesh size of the first screen is relatively small compared to that of the second screen.

5. An apparatus for disposing of and sorting waste, comprising:

a hopper for receiving waste;

a cylindrical drum with said hopper and having a discharge opening at a position opposite said hopper, said drum being provided with a first screen and a second screen axially disposed and the mesh size of said first screen being relatively small compared to that of said second screen;

a first shaft and a second shaft arranged coaxially with each other, said shafts centrally extending through said drum and being rotatably supported;

a first size reducing means mounted on said first shaft in opposed relation to said first screen within said drum;

a second size reducing means mounted on said second shaft in opposed relation to said second screen within said drum;

a first driving means coupled to said first shaft to rotate the same;

a second driving means coupled to said second shaft so as to rotate said second shaft independently from said first shaft and at a speed different from that of said first shaft; and a first outer cylinder and aa second outer cylinder disposed around said first and second screens, respectively, said first and said second cylinders being provided with a discharge opening, respectively, so as to discharge the sorted waste received therein which has passed through the corresponding screen.

* * * * *